United States Patent [19]

Sabongi et al.

[11] Patent Number: 4,594,312

[45] Date of Patent: Jun. 10, 1986

[54] HEAT BLEACHABLE DYE SYSTEMS

[75] Inventors: Gebran J. Sabongi, Woodbury, Minn.; Stephen S. C. Poon, Harlow; Bernard A. Lea, London, both of England

[73] Assignee: Minnesota Mining and Manufacturing Company, St. Paul, Minn.

[21] Appl. No.: 586,767

[22] Filed: Mar. 6, 1984

[30] Foreign Application Priority Data

Mar. 15, 1983 [GB] United Kingdom ..... 8307023

[51] Int. Cl.[4] ..... G03C 1/02; G03C 1/72

[52] U.S. Cl. ..... 430/339; 430/517; 430/522; 430/618; 430/619; 430/620; 428/913

[58] Field of Search ..... 430/517, 522, 339, 617, 430/618, 619, 620; 428/913

[56] References Cited

U.S. PATENT DOCUMENTS

| | | | |
|---|---|---|---|
| 3,627,527 | 12/1971 | Gilman et al. | 96/1.6 |
| 3,745,009 | 7/1973 | Jenkins et al. | 430/522 |
| 3,852,093 | 12/1974 | O'Leary | 430/334 |

OTHER PUBLICATIONS

J. C. McGowan—The Preparation of Bases from the Coloured Compounds Formed by Condensation of Furfuraldehyde with Aromatic Amines, pp. 777–779 (1949).

Elliot N. Marvell et al.—Formation of Phenylpyridinium Chloride from 5-5-Anilino-N-Phenyl-2,-4-Pentadienylidenimium Chloride in Acidic Media, pp. 2089–2092, Tetrahedron Letters No. 23, Pergamon Press.

K. G. Lewis et al.—Aspects of the Formation and Use of Stenhouse Salts and Related Compounds, pp. 463–475, Tetrahedron Report No. 26, Pergamon Press.

Journal of American Chemical Society, vol. 72, May 1950.

Chao-Tung Chen et al.—Dyes Derived from Furfural, Aniline, and Organic Acids—pp. 49–60.

Elliot N. Marvell et al.—Formation of Phenylpyridinium Chloride from 5-Anilino-N-Phenyl-2,-4-Pentadienylideniminium Chloride, Kinetics in Basic Media, pp. 5641–5649.

Elliot N. Marvell—Mechanism of the Formation of Phenylpyridinium Chloride From 1,7-Dipenyl-1,-7-Diazahepta-1,3,5-Triene-pp. 277–280, Tetrahedron Letters No. 3, Pergamon Press Ltd.

*Primary Examiner*—Won H. Louie

*Attorney, Agent, or Firm*—Donald M. Sell; James A. Smith; Mark A. Litman

[57] ABSTRACT

Photothermographic elements containing heat bleachable acutance/antihalation dyes and thermographic elements employing heat bleachable dyes of the formula:

(I)

in which:

n is 2, 3, 4 or 5, at least one of $R^1$ to $R^4$ represent hydrogen and the remainder of $R^1$ to $R^4$ independently represent a hydrogen atom, an optionally substituted cycloalkyl group, an optionally substituted alkenyl group, an optionally substituted alkyl group, an optionally substituted aryl group, an optionally substituted heterocyclic aromatic group, or $R^1$ and $R^2$ together or $R^3$ and $R^4$ together represent the necessary atoms selected from C, N, O and S to complete a non-aromatic type ring, $X^{\ominus}$ is an anion.

18 Claims, 1 Drawing Figure

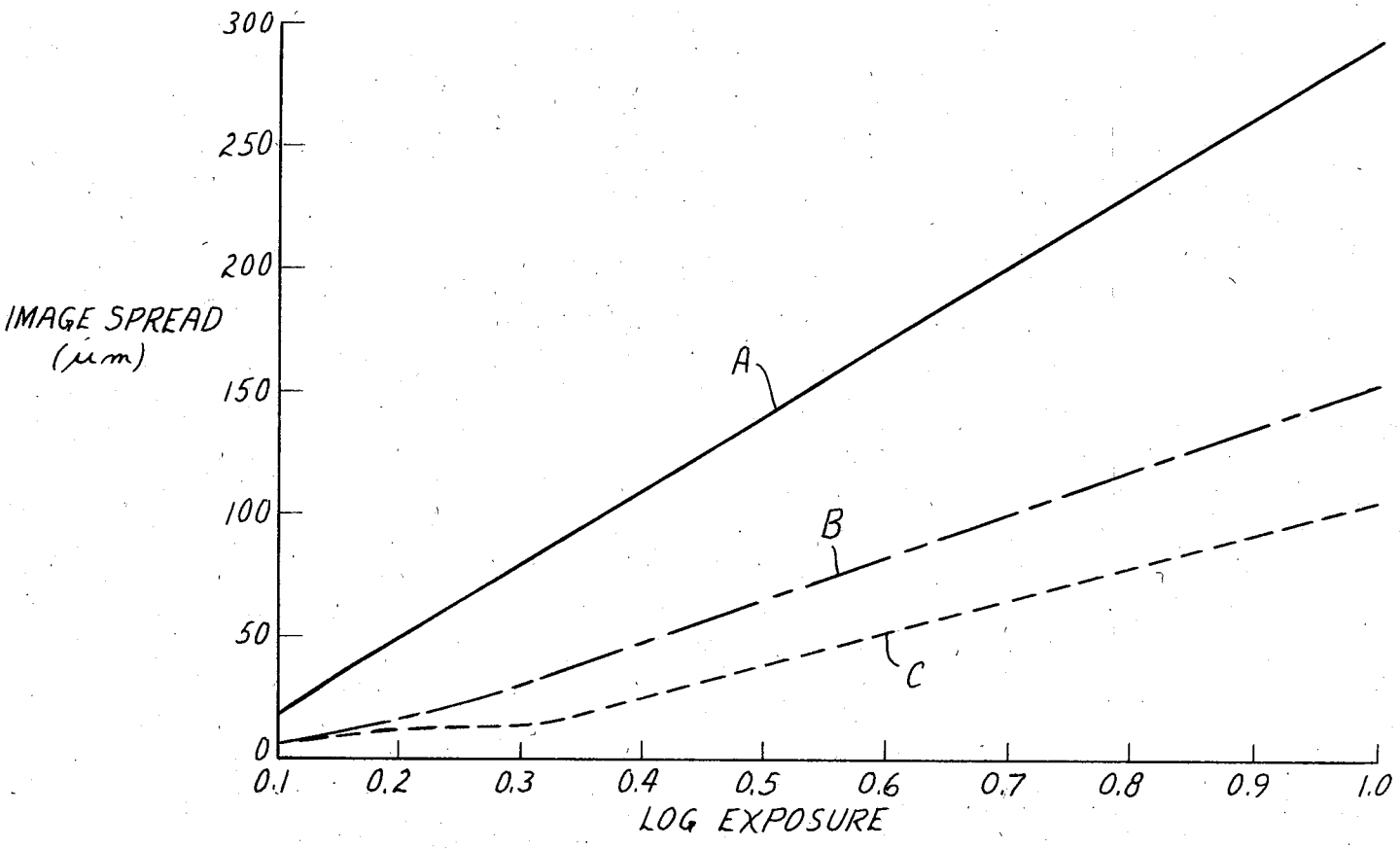
IMAGE SPREAD
(μm)
300
250
200
150
100
50
0
0.1
0.2
0.3
0.4
0.5
0.6
0.7
0.8
0.9
1.0
LOG EXPOSURE
A
B
C

HEAT BLEACHABLE DYE SYSTEMS

FIELD OF THE INVENTION

This invention relates to a dye bleach system and in particular to dry processable elements incorporated in a heat sensitive dye bleach system.

BACKGROUND TO THE INVENTION

Radiation-sensitive dye bleach systems are well known and include photosensitive systems and heat sensitive systems. Heat sensitive, dye bleach systems have found utility in thermographic imaging and for antihalation applications in light sensitive elements.

Known heat sensitive dye bleach systems suitable for thermographic imaging including thermochromic compounds disclosed in British Patent Specification No. 1 356 840 and systems comprising hexaamine-cobalt (III) complexes and a pyrylium dye are disclosed in Research Disclosure, September 1980 page 366. U.S. Pat. No. 3,852,093 discloses the use of quinoneimine dyes and a mild reducing agent, U.S. Pat. No. 3,609,360 discloses an acid release process and U.S. Pat. No. 3,684,552 discloses a base release process. All of these systems providing a route for thermo-imaging.

The use of antihalation and acutance dyes to improve the imaging sharpness in photographic systems by absorbing unwanted scattered or reflected light from the base or light sensitive layer of an element is well known. The dyes are usually removed or bleached to a colourless state during or after processing of the element.

Dry silver systems which comprise a thermally developable photosensitive mixture of light sensitive silver halide with a silver salt of an organic fatty acid, e.g. behenic acid, are known and disclosed, for example, in U.S. Pat. Nos. 3,152,904 and 3,457,075. Dry silver systems also require antihalation and/or acutance in order to ensure a sharp image, which dyes must be stable under the manufacture and storage conditions of dry silver but readily bleachable during or after the heat development step. Known dyestuffs and processes suitable for antihalation applications in dry silver systems include thermally bleachable dyes as disclosed in U.S. Pat. Nos. 3,745,009, 4,033,948, 4,088,497, 4,153,463, 4,283,487, 3,615,432 and 4,197,131; photobleachable o-nitroarylidene dyes as disclosed in U.S. Pat. No. 4,028,113; and thermochromic dyes as disclosed in U.S. Pat. No. 3,769,019.

In general, the known antihalation dyes and processes for use in dry silver systems suffer from one or more of the following disadvantages. They may have a limited scope of application and must be used in specific types of dry silver formulations, they may have a post-bleach residue which causes undesirable background colouration, they may be limited to their use in a layer separate from the light sensitive layers or must be used within the light sensitive layer, and certain of the useful dyes require a long complex synthetic route for their synthesis.

Th. Zinke, Ann., 330, 361 (1904) and Th. Zinke et al, ibid, 333, 296 (1904) disclose the preparation of crystalline, deeply coloured salts of 5-anilino-N-phenyl-2,4-pentadienylideniminium chloride and the property of the salt to undergo ring closure upon heating to yield phenylpyridinium chloride and aniline:

(A)

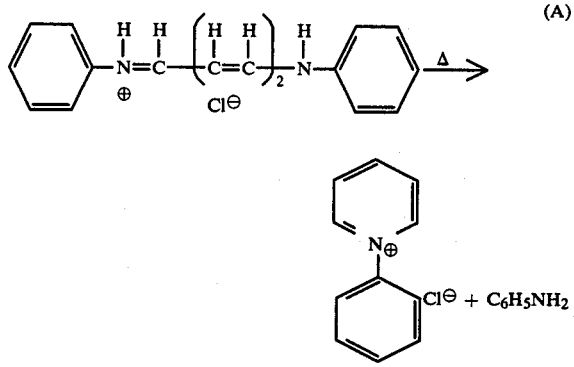

J. C. McGowan, *J. Chem. Soc.*, 777 (1949) and K. G. Lewis and C. E. Mulquiney, *Tetrahedron*, 33, 463 (1977) disclose a similar ring closure reaction:

(B)

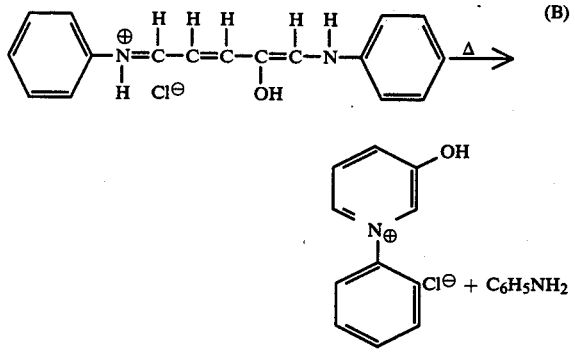

Cyanine dyes having structures similar to formulae (A) and (B) above are extensively reported in the patent literature and are often referred to as streptocyanines. Such dyes have been disclosed as intermediates for the synthesis of oxonol dyes in U.S. Pat. No. 3,933,798 and British Patent Specification No. 1 338 799, as sensitising dyes for photographic elements in U.S. Pat. No. 3,369,904 and as antihalation or filter dyes in silver halide photographic materials which decolourise in the developing solutions in British Patent Specification No. 632 640. U.S. Pat. No. 3,627,527 discloses the use of streptocyanine dyes as sensitising dyes for organic photoconductors and discloses that the dyes undergo an absorption shift or become substantially decolourised upon heating when employed in sensitising amounts.

However, heretofore it has not been appreciated that a certain group of streptocyanine dyes bleach sufficiently cleanly and irreversibly upon heating to allow their use as heat bleachable antihalation or acutance dyes and as the image-forming component of a thermographic system.

SUMMARY OF THE INVENTION

Therefore according to one embodiment of the present invention there is provided a photothermographic element comprising a support having on one surface thereof one or more layers constituting a photothermographic medium, the element additionally comprising as an acutance/antihalation dye a bleachable dye of the formula:

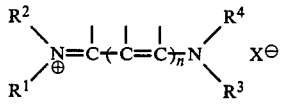

(I)

in which:

n is 2, 3, 4 or 5, at least one of $R^1$ to $R^4$ represents hydrogen and the remainder of $R^1$ to $R^4$ independently represent a hydrogen atom, an optionally substituted cycloalkyl group, an optionally substituted alkenyl group, an optionally substituted alkyl group, an optionally substituted aryl group, an optionally substituted heterocyclic aromatic group, or $R^1$ and $R^2$ together or $R^3$ and $R^4$ together represent the necessary atoms selected from C, N, O and S to complete a non-aromatic type ring, $X^{\ominus}$ is an anion, the free bonds of the polymethine chain being satisfied by hydrogen or any chain substituent of the type present in known cyanine dyes, said bleachable dye either being (a) in reactive association with a mild reducing agent, or (b) present in the element in an environment free from reducing agent.

The invention also provides a thermographic element comprising a support bearing an imaging layer, the imaging layer having as its image-forming component one or more dyes of formula (I).

DETAILED DESCRIPTION OF THE DRAWINGS

The accompanying drawing represents a plot of image spread against log exposure (in excess of that necessary to give a reflectance optical density of 1.3) which summarises the results of tests conducted on a dry silver element bearing a topcoat bleachable antihalation layer in accordance with the invention and a similar dry silver element without the antihalation layer. The improvement in image quality is essentially indicated by the gradient of the lines, the lower gradient indicating lower image spread. The detailed experimental conditions are reported hereinafter in Example 1.

It has been found that the dyes of formula (I) undergo substantially complete bleaching to a colourless transparent form upon heating to elevated temperatures, normally within the range 100° to 150° C. The temperature and time required for complete bleaching varies significantly with the dye structure and the environment of the dye. The presence of a binder, the type of binder, pH, presence of plasticisers and other reactants, e.g. reducing agents, affect the bleaching rate of the dyes.

For utility as acutance/antihalation dyes in dry silver materials, the dyes are selected to bleach at a temperature of at least 100° C., preferably 115° to 150° C., most preferably 115° to 135° C., and show no significant bleaching when exposed to temperatures of 80° to 90° C. for a few seconds since the latter conditions may be encountered during preparation of the photothermographic element.

The substituents selected from $R^2$ and/or $R^4$ affect the colour of the dye and the optimum bleaching temperature. Electron donating substituents, e.g. $CH_3S$— and $CH_3O$— will raise the optimum bleaching temperature and accordingly allow more latitude with the temperatures used during drying of the coated layers. Low bleaching temperatures are obtained by selection of electron withdrawing substituents for $R^2$ and/or $R^4$.

The presence of a binder greatly influences the rate of bleaching. Binders having a high thermal transition temperature increase the temperature and time for optimum bleaching. The bleaching rate can be increased significantly by the presence of a plasticiser and it appears that binder compositions having low softening points allow faster bleaching at lower temperatures. The effects of different binders and plasticisers will be demonstrated in the Examples hereinafter.

The bleaching rate of dyes of formula (I) is affected by pH. In general, the time and temperature required for complete bleaching is increased in the presence of small amounts of acid and decreased by the presence of small amounts of base.

The presence of reducing agent tends to lower the temperature required for complete bleaching. This property can conveniently be exploited in photothermographic elements which employ a mild organic reducing agent in the imaging components.

The dye of formula (I) and reducing agent may be present in the same layer or in adjacent layers providing the binder allows some migration or diffusion of one or both compounds. Suitable mild organic reducing agents are disclosed in U.S. Pat. No. 3,457,075 and include compounds containing an aromatic hydroxy group or amide or amino groups. Examples of such reducing agents include substituted phenols, hydroquinone, phenidone, phthalazinone, ascorbic acid and hydroxypyrimidine.

The reducing agent is generally used in at least a stoichiometric amount with respect to the dye, and may be used in an excess of up to 50 times this amount, generally up to 10 times this amount.

The thermal bleaching of the dyes of formula (I) may be enhanced by the presence of catalytic amounts of metal ions generally selected from Groups II or III of the Periodic Table, or preferably from the Transition Elements. The ions derived from silver, iron, cobalt, nickel, copper and zinc are particularly beneficial.

The presence of such catalytic metal ions allows the bleaching reaction to occur at usefully lower temperatures.

The metal ions are generally added in the form of an alkyl- or aryl-carboxylate salt, e.g. behenate, stearate or benzoate salts. Some degree of control may be exerted on the bleaching rate by altering the particular anion used.

In dry silver elements there is already present a silver salt such as silver behenate. Thus, any silver behenate which comes into catalytic association with the dye and reducing agent will usefully catalyse the bleaching reaction without the necessity of adding further metal soap catalyst, and possibly encountering problems of compatibility between the bleaching catalyst and the components of the light sensitive layer.

The photothermographic elements of the invention preferably comprise dry silver systems and the dye(s) of formula (I) are included in an amount to provide a transmissive optical density to white light of 0.05 to 0.8, preferably from 0.1 to 0.4 The dyes may be incorporated in:

(i) in a layer on the side of the support opposite the light-sensitive layer provided said support is transparent, (ii) in a layer between the support and the light-sensitive layer,
(iii) with the light sensitive layer,
(iv) within the toner layer, or
(v) in a separate layer over the toner layer, or
(vi) over the light-sensitive layer if no toner layer is present.

The presence of the dye enhances the image sharpness and bleaches completely during thermal image development of the dry silver system.

The thermographic elements of the invention have utility in the field of overhead visuals, direct-read-after-write systems and hard copies from electronic outputs to provide a recording of a thermal image. The elements comprise a suitable support having an imaging layer comprising one or more dyes of formula (I) present in an amount to provide a transmissive optimum density to white light in the range 0.5 to 1.5, generally about 0.8. The dyes are generally coated in a polymeric binder. Suitable substrates include transparent plastics film and paper. The elements provide a thermal image which is stable under the normal conditions encountered for hard copies and overhead visuals.

There are may known dyes within the scope of formula (I) and a general review of such dyes is provided in "Rodd's Chemistry of Carbon Compounds", S. Coffrey, Vol. IVB, p.411ff, 1977. At least one of $R^1$ to $R^4$ must represent hydrogen. It has been found that when each of $R^1$ to $R^4$ is other than hydrogen the bleaching time and rate of the dye is significantly increased to such an extent that the dyes may not bleach. Similarly, dyes in which n is 0 or 1 do not readily bleach.

The remainder of $R^1$ to $R^4$ are selected from:

hydrogen, optionally substituted alkyl groups generally containing up to 8 carbon atoms, preferably up to 4 carbon atoms, suitable substituents on the alkyl groups being selected from halogen, carboxyl groups, alkoxy groups containing up to 4 carbon atoms, alkyl thio groups containing up to 4 carbon atoms, optionally substituted cycloalkyl groups, e.g. cyclohexane, suitable substituents being selected from those recited above with respect to the alkyl groups and additionally including alkyl groups of 1 to 4 carbon atoms, optionally substituted alkenyl groups containing up to 8 carbon atoms, preferably 2 to 4 carbon atoms, suitable substituents being selected from those recited above with respect to the alkyl groups, an optionally substituted aryl group, generally containing less than 20 atoms selected from C, N, O and S, suitable substituents being selected from those recited above with respect to the alkyl groups.

Preferably, at least one of $R^2$ and $R^4$ represents a phenyl group which may possess one or more substituents selected from halogen, carboxyl groups, alkyl groups containing up to 4 carbon atoms, alkoxy groups containing up to 4 carbon atoms or alkylthio groups, $R^5S$, in which $R^5$ represents an alkyl group containing up to 4 carbon atoms.

The free bonds of the polymethine chain are preferably satisfied by hydrogen and optionally one of the carbon atoms may possess a hydroxy group. However, other substituents may be present on the polymethine chain, e.g. alkyl, alkoxy, aryl and aryloxy groups, which groups may be substituted and generally contain up to 8 carbon atoms. Halogen atoms, i.e. iodine, bromine, chlorine and fluorine, and CN groups may also be substituted on the polymethine chain. Although chain substituents are not generally preferred, they are well known in the cyanine dye art and the choice of substituents is used for fine tuning of the colour of the dye.

$X^{\ominus}$ represents any anion conventionally employed in cyanine dyes, e.g. Cl, Br, I, $ClO_4$, $BF_4$, p-toluene sulphonate.

The dyes of formula (I) may be prepared by several known reaction schemes:

SCHEME (1)

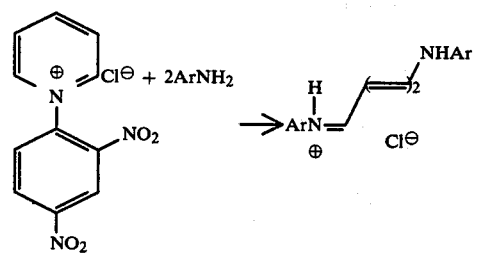

Ar = optionally substituted aryl

The general preparative procedure comprises adding a member of the aniline family (2 moles) to a solution of 1-(2,4-dinitrophenyl)pyridinium chloride (1 mole) in ethanol (1 liter). The mixture is warmed over a steam-bath until boiling starts and left overnight stirring at room temperature. The precipitated dye is filtered and washed by stirring in butan-2-one (500 ml) for 15 minutes and then separated by filtration. This is repeated three times after which the dye is recrystallised from ethanol.

The above procedure is disclosed in P. Baumgarten, Ber. 57, 1622 (1924) and ibid. 59, 1166 (1926).

Alternative procedures equivalent to scheme (1) are found in "The Chemistry of Heterocyclic Compounds, Pyridine and Derivatives Part 2", A. Weissberger (Ed), Interscience Publ. Inc., New York, Chapter III, page 58 (1961).

SCHEME (2)

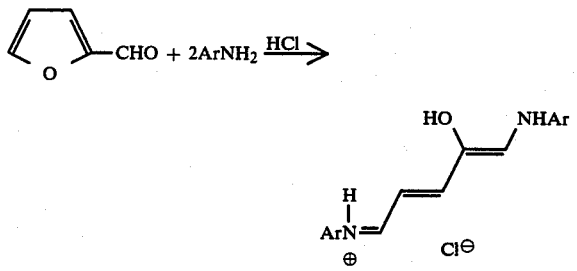

The general preparative procedure comprises adding a member of the aniline family (2 moles) to a solution of 2-furfural (1 mole) in ethanol (500 ml) and 85 ml hydrochloric acid solution (SG 1.18). The mixture is stirred at room temperature for 6 hours. The ethanol is then removed under vacuum and the solid washed with toluene (500 ml) by stirring for 15 minutes, then filtered. This is repeated three times. The dye is then filtered and dried in air. Recrystallisation is not very successful since heating these dyes triggers their cyclisation reaction into hydroxypyridinium compounds.

The above procedure is disclosed in J.A.C.S., 72, 2285 (1950) and J.C.S., 506 (1942).

SCHEME (3)

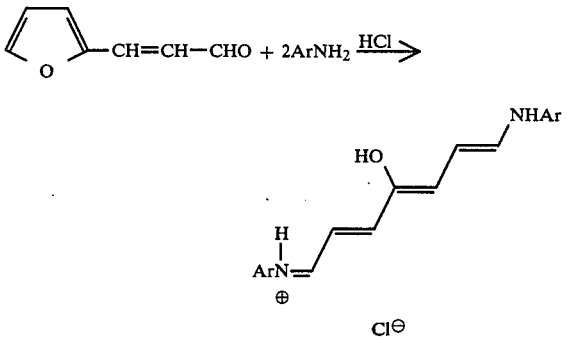

The general preparative procedure comprises adding a member of the aniline family (2 moles) to a solution of 3-(2-furyl)acrolein (1 mole) in ethanol (500 ml) and 85 ml HCl (SG 1.18). The mixture is stirred for 15 minutes, the ethanol evaporated under reduced pressure, and the solid washed with toluene (500 ml) by stirring for 15 minutes, then filtered. This is repeated three times. The dye is then filtered and dried in air.

The chain may be further extended by using 5-furylpenta-2,4-dien-1-al and 7-furylhepta-2,4,6-trien-1-al as starting materials in place of 3-(2-furyl)acrolein.

The above procedure is disclosed in W. Konig, J. Prakt. Chem., 1905 (ii), 72, 555; W. Konig, J. Prakt. Chem., 1913 (ii), 88, 193; and W. Konig, Ber., 1934, 67, 1274.

SCHEME (4)

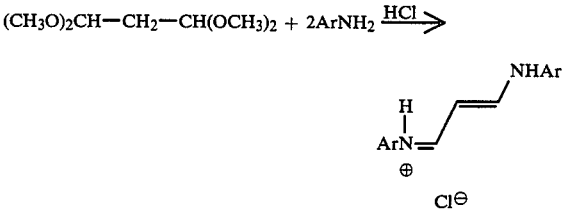

The general preparative procedure comprises adding a member of the aniline family (2 moles) to a solution of tetramethoxypropane (1 mole) in isopropanol (500 ml) and 85 ml HCl (SG 1.18). The mixture is heated on a steam-bath until all the starting materials are completely in solution. After a further ten minutes of heating, the solution is left to stand at room temperature for 12 hours. The precipitated yellow dye is filtered off. If no dye is precipitated, the solution is diluted with distilled water (500 ml) and the resulting precipitated solid filtered. The dye is recrystallised from isopropanol.

Dyes in which $R^1$ and $R^2$, and $R^3$ and $R^4$ together complete cyclic moieties are described in British Patent Specification No. 503 337 which discloses dyes having at each end of the polymethine chain, the group:

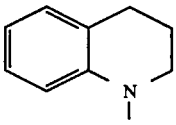

Dyes in which $R^1$ and $R^3$ are other than hydrogen are disclosed in H. E. Nikolajewski et al, Ber. 1967, 100, 2616, W. Konig, J. Prakt. Chem., 1904 (ii) 69, 105 and I. L. Knunyants et al, J. Gen. Chem. USSR 1939, 9, 557, the dyes in the latter reference having the substituent $CH_3S$ on the polymethine chain.

Dyes in which $R^1$ is not the same as $R^3$, and $R^2$ is not the same as $R^4$ are disclosed in Zincke, Ann. (1903) 338, 107; Ann. (1905) 341, 365 and Ann. (1915) 408, 285.

Examples of dyes within the scope of formula (I) which have been prepared by the methods reported herein are recorded in the following Table 1 in which $\lambda_{max}$ and extinction coefficients are measured in methanol, acidified with 1 to 2% by volume 1N hydrochloric acid. Dye Nos. 1 to 26 are suitable for use in the invention; Dye Nos. 27 to 31 are dyes outside the scope of the invention but similar in structure to formula (I).

TABLE 1

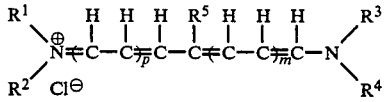

| Dye No. | $R^1$ | $R^2$ | $R^3$ | $R^4$ | $R^5$ | p | m | melting point °C. | $\lambda_{max}$ nm ($\epsilon \times 10^4$) |
|---|---|---|---|---|---|---|---|---|---|
| 1 | H | 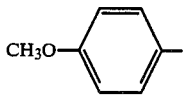 | $R^2$ | H | H | 0 | 1 | 109 | 510 (10.0) |
| 2 | H | 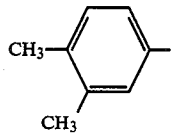 | $R^2$ | H | H | 0 | 1 | 124 | 490 (8.4) |

TABLE 1-continued
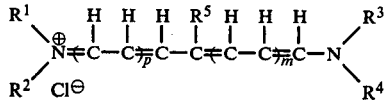
| Dye No. | $R^1$ | $R^2$ | $R^3$ | $R^4$ | $R^5$ | p | m | melting point °C. | $\lambda_{max}$ nm ($\epsilon \times 10^4$) |
|---|---|---|---|---|---|---|---|---|---|
| 3 | H | 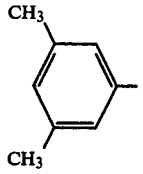 | $R^2$ | H | H | 0 | 1 | 126 | 488 (6.4) |
| 4 | H | 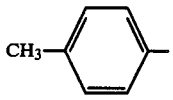 | $R^2$ | H | H | 0 | 1 | 112 | 484 (12.0) |
| 5 | H | 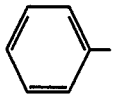 | $R^2$ | H | H | 0 | 1 | 115 | 492 (6.0) |
| 6 | H | 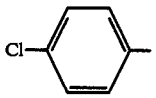 | $R^2$ | H | H | 0 | 1 | 118 | 500 (7.0) |
| 7 | H | 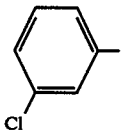 | $R^2$ | H | H | 0 | 1 | 109 | 480 (2.9) |
| 8 | H | 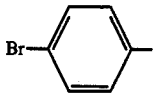 | $R^2$ | H | H | 0 | 1 | 110 | 495 (10.0) |
| 9 | H | 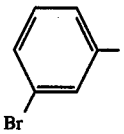 | $R^2$ | H | H | 0 | 1 | 109 | |
| 10 | H | 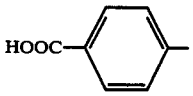 | $R^2$ | H | H | 0 | 1 | 152 | 500 (1.2) |
| 11 | H | 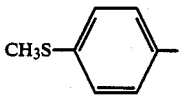 | $R^2$ | H | H | 0 | 1 | 108 | 510 (5.5) |
| 12 | H | 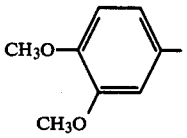 | $R^2$ | H | H | 0 | 1 | 122 | 515 (5.5) |

TABLE 1-continued
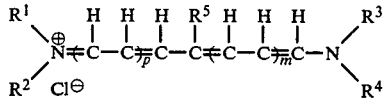
| Dye No. | $R^1$ | $R^2$ | $R^3$ | $R^4$ | $R^5$ | p | m | melting point °C. | $\lambda_{max}$ nm ($\epsilon \times 10^4$) |
|---|---|---|---|---|---|---|---|---|---|
| 13 | H | 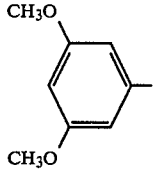 | $R^2$ | H | H | 0 | 1 | 136 | 496 (3.2) |
| 14 | H | 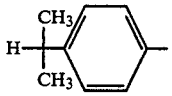 | $R^2$ | H | H | 0 | 1 | 144 | 490 (7.8) |
| 15 | H | 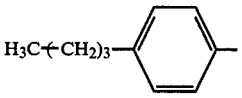 | $R^2$ | H | H | 0 | 1 | 125 | 490 (10.0) |
| 16 | H | 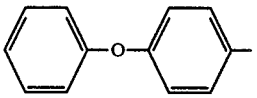 | $R^2$ | H | H | 0 | 1 | 150 | 495 (7.1) |
| 17 | H | 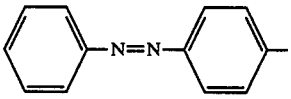 | $R^2$ | H | H | 0 | 1 | 156 | 550 (9.2) |
| 18 | H | 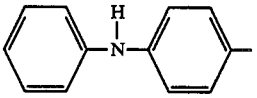 | $R^2$ | H | H | 0 | 1 | 162 | 547 (9.2) |
| 19 | H | 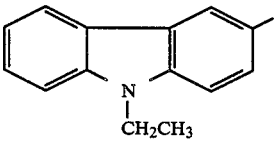 | $R^2$ | H | H | 0 | 1 | 156 | 528 (7.9) |
| 20 | H | 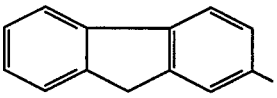 | $R^2$ | H | H | 0 | 1 | 150 | 520 (8.7) |
| 21 | H | 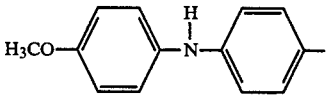 | $R^2$ | H | H | 0 | 1 | 185 | 557 (6.4) |
| 22 | H | 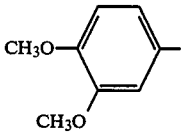 | $R^2$ | H | OH | 1 | 1 | 130 | 600 (2.7) |
| 23 | H | 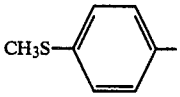 | $R^2$ | H | OH | 1 | 0 | 169 | 527 (2.3) |

TABLE 1-continued

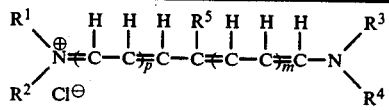

| Dye No. | $R^1$ | $R^2$ | $R^3$ | $R^4$ | $R^5$ | p | m | melting point °C. | $\lambda_{max}$ nm ($\epsilon \times 10^4$) |
|---|---|---|---|---|---|---|---|---|---|
| 24 | H | 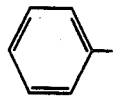 | $R^2$ | H | OH | 1 | 0 | 155 | 510 (1.9) |
| 25 | H | 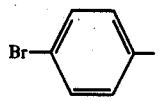 | $R^2$ | H | OH | 1 | 0 | 212 | 539 (2.3) |
| 26 | H | 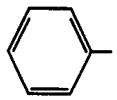 | $R^2$ | H | H | 1 | 1 | | 589 (>1) |
| 27 | H | 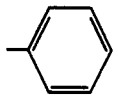 | $R^2$ | H | H | 0 | 0 | 222 | 386 (6.4) |
| 28 | H | 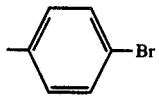 | $R^2$ | H | H | 0 | 0 | 252 | 396 (9.7) |
| 29 | $CH_3$ | 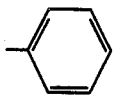 | $R^2$ | $CH_3$ | H | 0 | 1 | 105 | 451 (4.5) |
| 30 | $CH_3$ | $CH_3$ | $CH_3$ | $CH_3$ | H | 1 | 1 | | 508 (>1) |
| 31 | $CH_3$ | 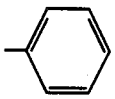 | $R^2$ | $CH_3$ | H | 1 | 1 | | 550 (>1) |

The invention will now be illustrated by the following Examples.

In the Examples the silver behenate half soap homogenate and dry silver systems used were prepared as follows:

HALF SILVER SOAP HOMOGENATE

Silver behenate half soap homogenate is a 100 g slurry of 45% w/w free behenic acid and 55% w/w silver behenate in 936 ml of acetone, homogenised to a smooth consistency.

DRY SILVER FORMULATION

| | parts by weight |
|---|---|
| silver behenate half soap formulation | 60 |
| toluene | 23 |
| polyvinyl butyral (B-76, Monsanto) | 11.05 |
| mercuric bromide solution (10% in methanol) | 0.099 |
| RA-1 (2,2'-methylene-bis-(4-methyl-6-t-butyl)phenol | 2.2 |
| Dye M-6 solution (0.1% in methanol) | 2 |
| Dye M-1 solution (0.1% in methanol) | 1 |

| Structure of dyes: | MeOH $\lambda_{max}$ |
|---|---|
| M-1 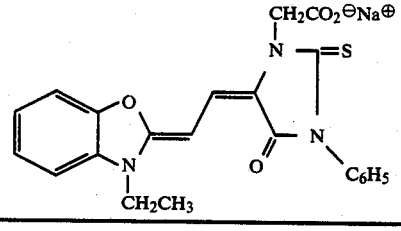 | 489 |

| Structure of dyes: | MeOH $\lambda_{max}$ |
|---|---|
| M-6 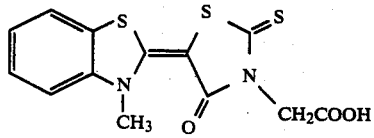 | 426 |

The above formulation was coated on an opaque poly(ethylene terephthalate) "polyester" base using a knife coater, at 3 mil (75 μm) wet thickness and dried at 80° C. for three minutes. The following toner layer was then coated at 3 ml (75 μm) wet thickness and dried at 80° C. for 3 minutes:

| Coating formulation | parts by weight |
|---|---|
| methanol | 9.0 |
| acetone | 69.2 |
| butan-2-one | 15.0 |
| cellulose acetate | 5.2 |
| phthalazine | 0.51 |
| tetrachlorophthalic acid | 0.11 |
| 4-methylphthalic acid | 0.36 |
| tetrachlorophthalic anhydride | 0.085 |

EXAMPLE 1

Bleachable dye added to topcoat of dry silver element

Dry silver elements were prepared according to the technique described above incorporating 2 ml or 4 ml of a 0.4% solution of Dye No. 5 in methanol in 100 g of toner layer formulation. The element was red-orange in colour after coating and drying. The dry silver elements together with a comparison comprising a dry silver element identical except for the absence of Dye No. 5, were exposed for different time periods and heat developed at 127° C. for 4 seconds to provide dense black images on a white background. An approximately circular patch of light consisting of a broad spectral region centred on 490 nm was imaged onto the material using a camera lens. Across the test target was an opaque strip producing an area of (nominally) non-exposed material approximately 1.7 mm wide.

Microdensitometer plots across one edge of the image, at various exposure levels, were made showing the effective changes in position of an edge as the exposure is increased beyond that necessary to reach maximum density. The true position of the edge for each separate image is shown by reference to a second edge at a fixed distance. The accompanying Figure provides an abstract of the results by showing the rate of change of image size (image spread) over a density of 1.3 as a function of excess exposure. This density is taken as an approximation to $D_{max}$ due to difficulty in defining the latter exactly. The improvement in image quality is essentially indicated by the gradient of the lines in the accompanying Figure, the lower gradient indicating lower image spread. A, B, C are respectively 0, 2, 4 ml dye.

EXAMPLE 2

Dry silver elements were prepared as in Example 1 containing 2 ml of a 0.4% dye solution in methanol in 100 g of toner formulation. The dry silver elements were heated at 127° C. for 4 seconds resulting in bleaching in heated areas only. The following Table 1 reports the dyes used and the colour of the dry silver element before and after heating.

| Dye No. | Colour before heating | Colour after heating |
|---|---|---|
| 1 | magenta | pinkish tint |
| 5 | red-orange | clear white |
| 6 | red-orange | clear white |
| 11 | magenta | clear white |
| 12 | magenta | pinkish tint |

EXAMPLE 3

This Example illustrates the use of Dye Nos. 5 and 24 in combination with various mild reducing agents-hydroquinone, metol and phenidone.

The coating formulations reported in the following Table were prepared by simple admixture and then hand coated using K-bar No. 8 (R. K. Chemicals Ltd.) at 3 mil (75 μm) wet thickness on a clear unsubbed polyester base and dried at 80° C. for 2 minutes.

| | Formulation No. | | | | | |
|---|---|---|---|---|---|---|
| Components | 1 | 2 | 3 | 4 | 5 | 6 |
| polyvinyl acetate (g) (33% in MeOH) | 10 | 10 | 10 | 10 | 10 | 10 |
| tetrachlorophthalic acid (0.4% in acetone) (ml) | 0.1 | 0.1 | 0.1 | 0.1 | 0.1 | 0.1 |
| Dye No. 5 (solid) (g) | 0.01 | 0.01 | 0.01 | — | — | — |
| Dye No. 24 (solid) (g) | — | — | — | 0.01 | 0.01 | 0.01 |
| hydroquinone (g) | 0.4 | — | — | 0.4 | — | — |
| metol (g) | — | 0.4 | — | — | 0.4 | — |
| phenidone (g) | — | — | 0.4 | — | — | 0.4 |

Each sample was heated at 127° C. for 4 seconds and the transmissive dye density was measured to white light before and after heating. The results are recorded in the following Table.

| | Formulation No. | | | | | |
|---|---|---|---|---|---|---|
| Dye Density | 1 | 2 | 3 | 4 | 5 | 6 |
| before heating | 0.23 | 0.36 | 0.25 | 0.42 | 0.45 | 0.33 |
| after heating | 0.16 | 0.29 | 0.10 | 0.23 | 0.30 | 0.10 |

Further heating will cause a reduction in the dye density of, especially, Formulations 2, 4 and 5.

EXAMPLE 4

This Example illustrates the use of Dye Nos. 8, 11 and 24 in combination with various mild reducing agents—phthalazinone, RA1 and 4,6-dihydroxypyrimidine.

The procedures of Example 3 were followed using the coating formulations reported in the following Table.

TABLE

| | Formulation No. | | | | | | | | |
|---|---|---|---|---|---|---|---|---|---|
| Components | 7 | 8 | 9 | 10 | 11 | 12 | 13 | 14 | 15 |
| polyvinyl acetate (33% in MeOH) (g) | 10 | 10 | 10 | 10 | 10 | 10 | 10 | 10 | 10 |
| tetrachlorophthalic acid (0.4% in acetone) (ml) | 0.1 | 0.1 | 0.1 | 0.1 | 0.1 | 0.1 | 0.1 | 0.1 | 0.1 |
| Dye No. 24 (g) | 0.01 | — | — | 0.01 | — | — | 0.01 | — | — |
| Dye No. 8 (g) | — | 0.01 | — | — | 0.01 | — | — | 0.01 | — |
| Dye No. 11 (g) | — | — | 0.01 | — | — | 0.01 | — | — | 0.01 |
| phthalazinone (g) | 0.4 | 0.4 | 0.4 | — | — | — | — | — | — |
| RA1 (g) | — | — | — | 0.4 | 0.4 | 0.4 | — | — | — |

TABLE-continued

| Components | Formulation No. 7 | 8 | 9 | 10 | 11 | 12 | 13 | 14 | 15 |
|---|---|---|---|---|---|---|---|---|---|
| 4,6-dihydroxypyrimidine (g) | — | — | — | — | — | — | 0.4 | 0.4 | 0.4 |

The samples were heated as in Example 3 and the dye density to white light measured before and after heating is reported in the following Table.

| Dye density | Formulation No. 7 | 8 | 9 | 10 | 11 | 12 | 13 | 14 | 15 |
|---|---|---|---|---|---|---|---|---|---|
| before heating | 0.32 | 0.11 | 0.32 | 0.36 | 0.13 | 0.32 | 0.30 | 0.15 | 0.32 |
| after heating | 0.04 | 0.05 | 0.04 | 0.07 | 0.04 | 0.08 | 0.12 | 0.09 | 0.10. |

Further heating will cause a reduction in the dye density of, especially, Formulations 16, 17, 18, 19 and 21.

EXAMPLE 6

This Example illustrates the effect of the half silver soap prepared as hereinbefore described and behenic acid on the bleachability of various dyes in association with the mild reducing agent, RA1.

The procedures of Example 3 were followed using the coating formulations reported in the following Table.

TABLE

| Components | Formulation No. 22 | 23 | 24 | 25 | 26 | 27 | 28 | 29 | 30 |
|---|---|---|---|---|---|---|---|---|---|
| Butvar B-76 (10% in EtOH) (g) | 10 | 10 | 10 | 10 | 10 | 10 | 10 | 10 | 10 |
| RA1 (g) | 0.4 | 0.4 | 0.4 | 0.4 | 0.4 | 0.4 | 0.4 | 0.4 | 0.4 |
| tetrachlorophthalic acid (0.4% in acetone) (ml) | 0.1 | 0.1 | 0.1 | 0.1 | 0.1 | 0.1 | 0.1 | 0.1 | 0.1 |
| ethanol (ml) | 2 | 2 | 2 | 2 | 2 | 2 | 2 | 2 | 2 |
| half soap* (g) | 0.05 | 0.05 | 0.05 | — | — | — | — | — | — |
| behenic acid (g) | — | — | — | 0.05 | 0.05 | 0.05 | — | — | — |
| Dye No. 5 (g) | 0.01 | — | — | 0.01 | — | — | 0.01 | — | — |
| Dye No. 1 (g) | — | 0.01 | — | — | 0.01 | — | — | 0.01 | — |
| Dye No. 8 (g) | — | — | 0.01 | — | — | 0.01 | — | — | 0.01 |

*as defined previously

The dye densities of the elements before and after heating measured as in Example 3 are reported in the following Table.

| Dye density | Formulation No. 22 | 23 | 24 | 25 | 26 | 27 | 28 | 29 | 30 |
|---|---|---|---|---|---|---|---|---|---|
| before heating | 0.19 | 0.30 | 0.14 | 0.20 | 0.28 | 0.13 | 0.23 | 0.36 | 0.14 |
| after heating | 0.06 | 0.06 | 0.06 | 0.10 | 0.12 | 0.10 | 0.10 | 0.25 | 0.10 |

EXAMPLE 5

This Example illustrates the use of a range of dyes in combination with RA1, a mild reducing agent commonly present in dry silver systems.

The procedures of Example 3 were followed using the coating formulations reported in the following Table.

TABLE

| Components | Formulation No. 16 | 17 | 18 | 19 | 20 | 21 |
|---|---|---|---|---|---|---|
| Butvar B-76 (10% in ethanol) (g) | 10 | 10 | 10 | 10 | 10 | 10 |
| tetrachlorophthalic acid (0.4% in acetone) (ml) | 0.1 | 0.1 | 0.1 | 0.1 | 0.1 | 0.1 |
| RA1 (g) | 0.4 | 0.4 | 0.4 | 0.4 | 0.4 | 0.4 |
| Dye No. 5 (g) | 0.01 | — | — | — | — | — |
| Dye No. 4 (g) | — | 0.01 | — | — | — | — |
| Dye No. 1 (g) | — | — | 0.01 | — | — | — |
| Dye No. 24 (g) | — | — | — | 0.01 | — | — |
| Dye No. 23 (g) | — | — | — | — | 0.01 | — |
| Dye No. 11 (g) | — | — | — | — | — | 0.01 |

The dye densities of the elements before and after heating measured as in Example 3 are reported in the following Table.

| Dye density | Formulation No. 16 | 17 | 18 | 19 | 20 | 21 |
|---|---|---|---|---|---|---|
| before heating | 0.24 | 0.34 | 0.44 | 0.43 | 0.28 | 0.44 |
| after heating | 0.13 | 0.27 | 0.33 | 0.27 | 0.08 | 0.24 |

EXAMPLE 7

This Example illustrates a dye bleach formulation suitable for the production of a visual for overhead projection. The following formulations were prepared.

| Part A - Dye solution | |
|---|---|
| Dye No. 11 (solid) | 0.1 g |
| methanol | 15.0 g |
| butan-2-one | 5.0 g |
| tetrachlorophthalic acid (0.4% in acetone) | 2.0 ml |

The dye was completely dissolved in the solution.

| Part B | |
|---|---|
| half silver soap homogenate | 0.4 g |
| toluene | 2.0 ml |
| B-76 Butvar solution (polyvinyl butyral) (20% in ethanol) | 20.0 g |

-continued

| Part B | |
|---|---|
| RA1 | 2.0 g |

The half soap was completely dissolved before addition of the Butvar and RA1.

Part A was added to Part B with stirring. The resulting solution was coated at 3 mil (75 μm) wet thickness over a clear polyester base and allowed to dry at room temperature.

Compositions of the invention have been satisfactorily passed through a Thermo-Fax processor (Minnesota Mining and Manufacturing Company) where the elements were heated by exposure to an infrared source while in intimate contact with a positive alpha-numeric image on paper. The heat created in the infrared radiation absorbing image areas, caused the coating in intimate contact to bleach and a negative of the original was obtained.

EXAMPLE 8

This Example illustrates the effect of added metal salts on the bleaching rate and bleaching temperature of Dye No. 1 in combination with mild reducing agent RA1.

The coating formulations reported in the following Table were prepared by simple admixture and then hand coated using a No. 6 K-bar (R. K. Chemicals Limited) on a clear polyester base followed by drying at 70° to 80° C. for 2 minutes.

TABLE

| Formulation No. | 31 | 32 | 33 | 34 | 35 |
|---|---|---|---|---|---|
| Butvar B-76 (10% in ethanol) (g) | 10 | 10 | 10 | 10 | 10 |
| Tetrachlorophthalic acid (0.4% in acetone) (ml) | 0.1 | 0.1 | 0.1 | 0.1 | 0.1 |
| RA1 (g) | 0.4 | 0.4 | 0.4 | 0.4 | 0.4 |
| Dye No. 1 (g) | 0.01 | 0.01 | 0.01 | 0.01 | 0.01 |
| ethanol (ml) | 2 | 2 | 2 | 2 | 2 |
| silver behenate half soap | — | 0.05 | — | — | — |
| ferric benzoate | — | — | 0.05 | — | — |
| zinc benzoate | — | — | — | 0.05 | — |
| cupric benzoate | — | — | — | — | 0.05 |

The samples were evaluated in each of two ways—firstly by heating to 127° C. for 5 seconds and thereafter measuring the transmissive optical density to white light of samples heated or not and, secondly, by heating on a thermal step wedge (100° to 140° C. in 5 C.° increments) for a period of 10 seconds and thereafter noting the lower temperature required for the transmissive optical density to white light to drop to 0.1 or below.

| Formulation No. | 31 | 32 | 33 | 34 | 35 |
|---|---|---|---|---|---|
| Optical density | | | | | |
| (a) before heating | 0.30 | 0.36 | 0.32 | 0.32 | 0.24 |
| (b) after heating | 0.21 | 0.04 | 0.10 | 0.18 | 0.07 |
| Temperature °C. where OD reaches 0.1 or below. | 135 | 100 | 110 | 115 | — |

EXAMPLE 9

This Example compares the bleaching rates of dyes in accordance with the invention and comparative dyes of similar structure in different environments.

The basic formulation used comprised:

| | |
|---|---|
| dye | 0.01 g |
| methanol | 5 ml |
| binder | 10 g |

The binders used were:

(A) 20% Butvar in ethanol (B) 10% cellulose acetate in butan-2-one.

Other additives were included in some formulations as reported in the following Table.

Each formulation was coated at 3 mil (75 μm) wet thickness on polyester film, using a knife coater, followed by drying at 80° C. for three minutes. The samples were evaluated for bleachability by placing the dried film against a heat bar with a gradient from 100° to 140° C., and noting the time and temperature required to effect essentially complete bleaching of the dye colour. The results obtained are recorded in the following Table in which CAO-5=2,2'-methylene-bis-(4-methyl-6-t-butyl)-phenol HQ=hydroquinone 4-CBP=4-chlorobenzoyl peroxide AgBeh=silver behenate.

TABLE

| Dye No. | Binder | CAO-5 | HQ | 4-CBP | AgBeh | Bleaching |
|---|---|---|---|---|---|---|
| 5 | A | | | | | 5 sec @ 100° C. |
| | B | | | | | 20 sec @ 140° C. |
| | B | 0.4 g | | | | 20 sec @ 137° C. |
| | B | | 0.4 g | | | 20 sec @ 140° C. (incomplete bleach) |
| | B | | | 0.4 g | | 20 sec @ 140° C. (incomplete bleach) |
| | B | | | | 0.05 g | 20 sec @ 113° C. |
| 11 | A | | | | | 5 sec @ 100° C. |
| | B | | | | | 20 sec @ 135° C. |
| | B | 0.4 g | | | | 20 sec @ 135° C. |
| | B | | 0.4 g | | | 20 sec @ 140° C. (incomplete bleach) |
| | B | | | 0.4 g | | 20 sec @ 140° C. |
| | B | | | | 0.05 g | 20 sec @ 113° C. (weak colour) |
| 18 | A | | | | | 5 sec @ 105° C. |
| | B | | | | | 20 sec @ 140° C. |
| | B | 0.4 g | | | | 20 sec @ 135° C. |
| | B | | 0.4 g | | | 20 sec @ 140° C. (incomplete bleach) |
| | B | | | 0.4 g | | 20 sec @ 140° C. (incomplete bleach) |
| | B | | | | 0.05 g | 20 sec @ 113° C. |
| 22 | A | | | | | 80° C. |
| | B | | | | | 80° C. |
| | B | 0.4 g | | | | 80° C. |
| | B | | 0.4 g | | | 80° C. |
| | B | | | 0.4 g | | 80° C. |
| | B | | | | 0.05 g | 80° C. |
| 24 | A | | | | | 5 sec @ 130° C. |
| | B | | | | | 20 sec @ 135° C. |
| | B | 0.4 g | | | | 20 sec @ 130° C. |
| | B | | 0.4 g | | | 20 sec @ 135° C. |
| | B | | | 0.4 g | | 20 sec @ 105° C. |
| | B | | | | 0.05 g | 20 sec @ 130° C. |
| 26 | A | | | | | 5 sec @ 130° C. |
| | B | | | | | 20 sec @ 135° C. |
| | B | 0.4 g | | | | 20 sec @ 120° C. |
| | B | | 0.4 g | | | 20 sec @ 130° C. |
| | B | | | 0.4 g | | 20 sec @ 110° C. |

TABLE-continued

| Dye No. | Binder | CAO-5 | HQ | 4-CBP | AgBeh | Bleaching |
|---|---|---|---|---|---|---|
| | B | | | | 0.05 g | 20 sec @ 130° C. (low density) |
| 27 | A | | | | | no bleaching |
| | B | | | | | no bleaching |
| | B | 0.4 g | | | | no bleaching |
| | B | | 0.4 g | | | no bleaching |
| | B | | | 0.4 g | | no bleaching |
| | B | | | | 0.05 g | no bleaching |
| 28 | A | | | | | no bleaching |
| | B | | | | | no bleaching |
| | B | 0.4 g | | | | no bleaching |
| | B | | 0.4 g | | | no bleaching |
| | B | | | 0.4 g | | no bleaching |
| | B | | | | 0.05 g | no bleaching |
| 29 | B | | | | | no bleaching |
| | B | 0.4 g | | | | no bleaching |
| | B | | 0.4 g | | | no bleaching |
| | B | | | | 0.05 g | no bleaching |
| 30 | A | | | | | no bleaching |
| | B | | | | | no bleaching |
| | B | 0.4 g | | | | no bleaching |
| | B | | 0.4 g | | | no bleaching |
| | B | | | 0.4 g | | no bleaching |
| | B | | | | 0.05 g | no bleaching |
| 31 | A | | | | | slight at 140° C. |
| | B | | | | | no bleaching |
| | B | 0.4 g | | | | no bleaching |
| | B | | 0.4 g | | | no bleaching |
| | B | | 0.4 g | | slight at 140° C. | |
| | B | | | | 0.05 g | low density overall |

It will be noted that the dyes of formula (I) in accordance with the invention all possess suitable bleaching characteristics whereas the comparative dyes (Dye Nos. 27 to 31) of similar structure do not bleach or have inferior bleaching characteristics.

EXAMPLE 10

The effect of different binder formulations upon the bleaching temperature and rate of a dye was investigated.

The basic formulation used comprised:

| | |
|---|---|
| Dye No. 18 | 0.01 g |
| Binder solution | 10 g |

The formulations were coated and the samples evaluated according to the procedures of Example 9.

| Binder | Bleaching |
|---|---|
| ethyl cellulose (10% in butan-2-one) | bleaches during drying at 80° C. |
| Butvar (20% in ethanol) | 5 seconds @ 100° C. |
| polyvinyl acetate (33% in methanol) | 125° C. in 10 seconds |
| cellulose acetate butyrate (8% in acetone) | 135° C. in 30 seconds |
| cellulose acetate (10% in acetone) | not complete at 140° C. in 20 seconds |
| Gantrez ES225M monoethyl ester of poly(methylvinyl ether/maleic acid) 50% solution in ethanol - methanol 9:1 GAF (Great Britain) Ltd. | slight at 140° C. in 30 seconds |

EXAMPLE 11

The effect of different quantities of plasticiser (polyethylene glycol) upon the bleaching temperature and rate of a dye was investigated.

The basic formulation used comprised:

| | |
|---|---|
| Dye No. 11 | 0.01 g |
| cellulose acetate (10% acetone) | 10 g |

The formulations were coated and the samples evaluated according to the procedures of Example 9.

| Polyethylene glycol | Bleaching |
|---|---|
| — | incomplete - 20 seconds at 140° C. |
| 0.1 g | incomplete - 10 seconds at 140° C. |
| 0.2 g | 125° C. for 10 seconds |
| 0.4 g | 100° C. for 10 seconds |
| 0.5 g | mostly bleached during drying @ 80° C. |

It will be noted that the presence of plasticiser significantly increases the bleaching rate and lowers the bleaching temperature.

EXAMPLE 12

The effect of pH upon the bleaching temperature and rate of a dye was investigated.

The basic formulation used comprised:

| | |
|---|---|
| Dye No. 11 | 0.01 g |
| Binder solution | 10 g |

The following binders were used:

(A) Butvar 20% in ethanol (B) Butvar 20% in butan-2-one

The pH conditions were varied using the following additives:

tetrachlorophthalic acid as 0.4% solution in acetone (TCPA)

4-methylphthalic acid as 0.4% solution in methanol (MPA)

phthalazine as 0.4% solution in methanol (PZ)

triethanolamine as 20% solution in ethanol (TEA)

tetrachlorophthalic acid anhydride as 0.4% solution in acetone (TCPAN)

| Binder | Additive/amount (ml) | Bleaching |
|---|---|---|
| A | — | 2 sec @ 100° C. |
| A | TCPA/0.1 | 2 sec @ 125° C. |
| A | MPA/0.1 | 2 sec @ 125° C. |
| A | TCPAN/0.1 | 2 sec @ 115° C. |
| A | PZ/0.1 | 2 sec @ 100° C. |
| A | TEA/0.1 | bleaches during drying @ 80° C. |
| B | — | 5 sec @ 100° C. |
| B | TCPA/0.1 | 5 sec @ 115° C. |
| B | TCPA/0.2 | 5 sec @ 125° C. |
| B | TCPA/0.3 | 5 sec @ 130° C. |
| B | TCPA/0.4 | 5 sec @ 130° C. |
| B | TCPA/0.5 | 5 sec @ 130° C. |

EXAMPLE 13

Photothermographic elements with bleachable antihalation dyes used in non-reactive association with mild reducing agents (i) Antihalation layer on reverse side of film Dry silver elements were prepared according to the technique hereinbefore described except that a transparent polyester base was used. A bleachable antihalation dye layer was incorporated into the elements using the following formulations:

| Components | Formulation A | Formulation B |
|---|---|---|
| Dye No. 11 (g) | 0.01 | — |
| Dye No. 18 (g) | — | 0.01 |
| methanol (ml) | 5 | 5 |
| tetrachlorophthalic acid (0.4% in acetone) (ml) | 0.1 | 0.1 |
| polyvinyl butyral (B-76:Monsanto) (20% in ethanol) (g) | 10 | 10 |

Formulations A and B were coated on different elements onto the opposite side of the polyester base to that containing the dry silver coating. The coatings were made using a knife coater at 3 mils (75 μm) wet thickness followed by drying at 80° C. for three minutes. The coating using formulation A was red-orange in colour and that using formulation B was a purple colour.

When the samples containing the antihalation layer were exposed and developed, it was seen that the images formed were much sharper than samples containing no antihalation dye and that the dyes bleached to an essentially colourless state during the heat development step of the dry silver element at 127° C. for 5 to 10 seconds.

(ii) Antihalation layer as an underlayer on the same side as a light sensitive layer A heat bleachable antihalation layer was prepared by coating onto reflective polyester base, formulation A at 3 mil (75 μm) wet thickness and drying at 80° C. for three minutes. A second layer was coated over the antihalation layer using polyvinyl alcohol (20% in water) coated at 3 mil (75 μm) wet thickness, followed by drying at 80° C. for three minutes. The dry silver photothermographic coating was then applied over the polyvinyl alcohol coating using the formulation and conditions hereinbefore described.

The dry silver element was a red-orange colour and, upon exposure and development as described above, sharp images were produced and the dye bleached to a colourless state during heat development at 127° C. for 5 to 10 seconds.

(iii) Antihalation layer as a separate top-coat layer over the dry silver light sensitive layer A dry silver element was prepared as hereinbefore described using a reflective polyester base. Over the toner layer, there was coated a polyvinyl butyral solution (20% in ethanol) at 3 mils (75 μm) wet thickness which was dried for three minutes at 80° C. Over the latter coating was coated the antihalation coating using formula A at 3 mils (75 μm) wet thickness followed by drying at 80° C. for three minutes.

The resulting photothermographic element had a red-orange colour, when exposed and developed sharp images were obtained and the dye was bleached to a colourless state during the heat development step at 127° C. for 5 to 10 seconds.

We claim:

1. A photothermographic element comprising a support having on one surface thereof one or more layers constituting a photothermographic medium, the element further comprising an acutance/antihalation dye which is bleachable by heating in the absence of reactants characterized in that said acutance/antihalation dye is a bleachable dye of the formula:

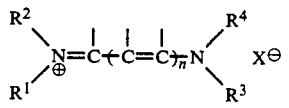

(I)

in which:

n is 2, 3, 4 or 5, at least one of $R^1$ to $R^4$ represent hydrogen and the remainder of $R^1$ to $R^4$ independently represent a hydrogen atom, an optionally substituted cycloalkyl group, an optionally substituted alkenyl group, an optionally substituted alkyl group, an optionally substituted aryl group, an optionally substituted heterocyclic aromatic group, or $R^1$ and $R^2$ together or $R^3$ or $R^4$ together represent the necessary atoms selected from C, N, O and S to complete a non-aromatic type ring, $X^{\ominus}$ is an anion, the free bonds of the polymethine chain being satisfied by hydrogen or any chain substituent of the type present in known cyanine dyes, said bleachable dye either being (a) in reactive association with a mild reducing agent, or (b) present in the element in an environment free from reducing agent wherein the dye of formula (I) is present in an amount to provide a transmissive optical density to white light of from 0.05 to 0.8.

2. An element as claimed in claim 1, in which the element comprises a light-sensitive layer comprising silver halide, a silver salt of an organic fatty acid, a mild reducing agent and a toner layer, the light-sensitive components of which element consist essentially of silver halide, characterised in that the dye of formula (I) is incorporated:

(i) in a layer on the side of the support opposite the light-sensitive layer provided said support is transparent, (ii) in a layer between the support and the light-sensitive layer, (iii) within the light sensitive layer, (iv) within the toner layer, or (v) in a separate layer over the toner layer, or (vi) over the light-sensitive layer if no toner layer is present.

3. The element of claim 2 characterised in that the dye is present in an amount to provide a transmissive optical density of from 0.1 to 0.4 and said dye is in reactive association with a catalytic amount of a metal ion selected from the group consisting of Group II, Group III, and transition metal ions.

4. A thermographic element comprising a support bearing an imaging layer, characterised in that the imaging layer has as its major image forming component one or more heat bleachable dyes of the formula:

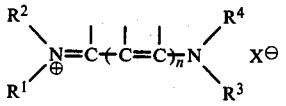

(I)

n which:

n is 2, 3, 4 or 5, at least one of $R^1$ to $R^4$ represent hydrogen and the remainder of $R^1$ to $R^4$ independently represent a hydrogen atom, an optionally substituted cycloalkyl group, an optionally substituted alkenyl group, an optionally substituted alkyl group, an optionally substituted aryl group, an optionally substituted heterocyclic aromatic group, or $R^1$ and $R^2$ together or $R^3$ and $R^4$ together represent the necessary atoms selected from C, N, O and S to complete a non-aromatic type ring, $X^-$ is an anion, the free bonds of the polymethine chain being satisfied by hydrogen or any chain substituent of the type present in known cyanine dyes, wherein the dye of formula (I) is present in an amount to provide a transmissive optical density to white light of from 0.5 to 1.5.

5. An element as claimed in claim 4 characterised in that the support is transparent and the element is suitable for use as a transparency for overhead projection.

6. An element as claimed in claim 2, characterised in that the polymethine chain is free from substituents.

7. An element as claimed in claim 4, characterised in that the polymethine chain is free from substituents.

8. An element as claimed in claim 4, characterised in that $R^2$ and/or $R^4$ is an optionally substituted aryl group containing up to 20 atoms selected from C, N, O and S.

9. An element as claimed in claim 7, characterised in that the dye of formula (I) is in reactive association with a mild organic reducing agent which is in a stoichiometric ratio relative to said dye or in an excess of up to 50 times this amount.

10. An element as claimed in claim 9, characterised in that the mild reducing agent is selected from substituted phenols, hydroquinone, phenidone, phthalazinone, ascorbic acid and hydroxypyrimidine.

11. An element as claimed in claim 2, characterised in that the dye is in reactive association with a catalytic amount of a metal ion of Group II or Group III or a transition metal ion.

12. An element as claimed in claim 6, characterised in that the support is transparent and the element is suitable for use as a transparency for overhead projection.

13. An element as claimed in claim 3, characterised fin that $R^1$ and $R^3$ are hydrogen.

14. An element as claimed in claim 4, characterised in that $R^1$ and $R^3$ are hydrogen.

15. An element as claimed in claim 14, characterised in that the polymethine chain is free from substituents.

16. An element as claimed in claim 7, characterised in that $R^2$ and/or $R^4$ is an optionally substituted aryl group containing up to 20 atoms selected from C, N, O and S.

17. An element as claimed in claim 15, characterised in that $R^2$ and/or $R^4$ is an optionally substituted aryl group containing up to 20 atoms selected from C, N, O and S.

18. An element as claimed in claim 17, characterised in that the dye of formula (I) is in reactive association with a mild organic reducing agent which is in a stoichiometric ratio relative to said dye or in an excess of up to 50 times this amount.

* * * * *